US008042462B2

(12) United States Patent
Kim

(10) Patent No.: US 8,042,462 B2
(45) Date of Patent: Oct. 25, 2011

(54) SLIDING T-SHIRTS PRINTING PALLET

(76) Inventor: Johnny Un Hyong Kim, Los Angeles, CA (US)

( * ) Notice: Subject to any disclaimer, the term of this patent is extended or adjusted under 35 U.S.C. 154(b) by 817 days.

(21) Appl. No.: 12/130,974

(22) Filed: May 30, 2008

(65) Prior Publication Data

US 2009/0293743 A1 Dec. 3, 2009

(51) Int. Cl.
*B41F 17/00* (2006.01)
*D06C 15/00* (2006.01)

(52) U.S. Cl. ..... 101/41; 223/61; 223/66; 101/126

(58) Field of Classification Search ..... 101/126, 101/129, 474, 41; 223/37, 61, 66, 69, 74
See application file for complete search history.

(56) References Cited

U.S. PATENT DOCUMENTS 5,016,367 A * 5/1991 Breen et al. ..... 38/135
5,188,034 A * 2/1993 Iaccino et al. ..... 101/474
5,199,353 A * 4/1993 Szyszko ..... 101/474
5,247,885 A * 9/1993 Iaccino et al. ..... 101/474
7,096,613 B1 * 8/2006 Springer ..... 38/138
7,413,301 B2 * 8/2008 Niimi et al. ..... 347/104

* cited by examiner

*Primary Examiner* — Daniel J Colilla
*Assistant Examiner* — Allister Primo
(74) *Attorney, Agent, or Firm* — John K. Park; Park Law Firm

(57) ABSTRACT

A sliding T-shirts printing pallet comprises a main body, two sliding arm plates, and two stretching bump portions. Each of two sliding arm plates is connected to a shoulder blade side of the main body and to slide along the shoulder blade side. The two stretching bump portions are for flattening an armpit portion of the T-shirts. The front surfaces of the two sliding arm plates are aligned with the front surfaces of the parallelogram top portion and the rectangular bottom portion of the main body so as to form a single plane. Each of the two sliding arm plates defines first and second latch position when the sliding arm plate is slid upward or downward respectively. The sleeve side is roughly aligned with the flank sides of the rectangular bottom portion of the main body when the sliding arm plates are at the first latch position.

15 Claims, 8 Drawing Sheets

SLIDING T-SHIRTS PRINTING PALLET

BACKGROUND OF THE INVENTION

The present invention relates to a sliding T-shirts printing pallet. More particularly, this invention relates to a sliding T-shirts printing pallet, which accommodates T-shirts of different sizes without strain on the T-shirts facilitating printing.

Printing patterns on a T-shirts is not a simple work. Fabric's readiness to crease and bunch makes it actually challenging to print on such T-shirts. Therefore, usually a board has been used to provide a firm and flat surface on which the T-shirts spread and then a pattern may be printed.

However, since the T-shirts and the board have portions for shoulder blades, it is not always easy to put on the T-shirts on the board to prepare to print. The T-shirts must be stretched to accommodate the board within, during the process of which the T-shirts can be stretched out beyond the fabric's resilience limit and damaged.

Accordingly, a need for a sliding T-shirts printing pallet has been present for a long time considering the expansive demands of T-shirts printing. This invention is directed to solve these problems and satisfy the long-felt need.

SUMMARY OF THE INVENTION

The present invention contrives to solve the disadvantages of the prior art.

An objective of the invention is to provide a sliding T-shirts printing pallet.

Another object of the invention is to provide a sliding T-shirts printing pallet, which can accommodate T-shirts of different sizes without strain on the T-shirts.

Still another object of the invention is to provide a sliding T-shirts printing pallet, which includes a main body and two sliding arm portions.

An aspect of the invention provides a sliding T-shirts printing pallet.

The sliding T-shirts printing pallet comprises a main body, two sliding arm plates, and two stretching bump portions.

The main body comprises a substantially parallelogram top portion and a substantially rectangular bottom portion. The substantially parallelogram top portion comprises a neck side, two shoulder sides, two shoulder blade sides, a lower chest side, a front surface, and a rear surface, and each of the shoulder blade sides extends from a corresponding one of the two shoulder sides and is tilted down outward. The substantially rectangular bottom portion comprises a chest side, a waist side, two flank sides, a front surface, and a rear surface, and the chest side extends from the lower chest side of the parallelogram top portion.

Each of two sliding arm plates is configured to be connected to a corresponding one of the two shoulder blade sides of the main body and to slide along the shoulder blade side, and comprises a sliding side, a shoulder side, an armpit side, a sleeve side, a front surface, and a rear surface.

The two stretching bump portions are for flattening an armpit portion of the T-shirts, and each of two stretching bump portions is disposed an inner edge of the armpit side of the sliding arm plates.

The front surfaces of the two sliding arm plates are aligned with the front surfaces of the parallelogram top portion and the rectangular bottom portion of the main body so as to form a single plane.

Each of the two sliding arm plates defines a first latch position when the sliding arm plate is slid upward and a second latch position when the sliding arm plate is slid downward.

Each of the sleeve sides is aligned relatively closely with a corresponding one of the flank sides of the rectangular bottom portion of the main body when the sliding arm plates are slid upward to the first latch position.

The sliding T-shirts printing pallet may further comprise two first sliding guides, two second sliding guides, two bottom plates, and two or more first glide bearings.

The two first sliding guides are fixed to the rear surface of the parallelogram top portion of the main body, and each comprises a first sliding side, a top surface, and a bottom surface.

The two second sliding guides are fixed to the rear surface of a corresponding one of the two sliding arm plates, and each comprises a top surface, a bottom surface, and a second sliding side which is configured to slide along the first sliding side of the first sliding guide. Each of the two second sliding guides comprises an oblong sliding slot extending generally parallel to the second sidling side.

Each of the two bottom plates is fixed to the rear surface of a corresponding one of the first sliding guides.

The two or more first glide bearings are fixed to the front surface of each of the bottom plates and to the rear surface of the main body so as to guide the second sliding guides along the oblong sliding slot.

Each of the first sliding guides may further comprise a stopping side for limiting movement of the corresponding second sliding guide and sliding arm plate.

The outermost first glide bearings may limit movement of the corresponding second sliding guide and sliding arm plate.

The front surfaces of the first sliding guides may be aligned with the front surfaces of the second sliding guides so as to form a single plane.

The sliding T-shirts printing pallet still may further comprise: a first impact-resistant layer fixed to the front surface of each of the bottom plates between and disposed between the bottom plate and the second sliding guide, and a second impact-resistant layer fixed to the rear surface of the parallelogram top portion of the main body and disposed between the parallelogram top portion and the first and second sliding guides.

Each of the first and second impact-resistant layers may comprise slippery UHMW Polyethylene.

Each of the first and second impact-resistant layers may comprise an adhesive layer for fixing.

Each of the first sliding guides may comprise two or more latching grooves at the corresponding first sliding side, and the sliding T-shirts printing pallet may further comprise two or more second glide bearings fixed to the front surface of each of the bottom plates and to the rear surface of the main body through corresponding two or more latching grooves so as to guide the second sliding guides along the sliding sides of the first sliding guides.

The sliding T-shirts printing pallet may further comprise two extending strips, each of which being for extending the top surface of the rectangular bottom portions sideways, and each of the extending strips may comprise a front surface and a rear surface.

The sliding T-shirts printing pallet may further comprise two connecting strips, each of which being for connecting the extending strips to the rectangular bottom portion at the rear surfaces of the rectangular bottom portion and the extending strip.

The sliding T-shirts printing pallet may further comprising: a plurality of holes provided in the main body, the sliding arm plates, first and second sliding guides, and the bottom plates, and a plurality of screws for fixing the main body, the sliding arm plates, first and second sliding guides, and the bottom plates with one another.

Each of the two stretching bump portions may have a generally parallelogram shape with round edge. Each of the two stretching bump portions may be integrated with the corresponding sliding arm plate.

According to another aspect of the invention, a method for printing a T-shirts using the sliding T-shirts printing pallet is provided.

The method comprises: sliding the two sliding arm plates up to the first latch positions; putting the T-shirts on the sliding T-shirts printing pallet from the neck side of the parallelogram top portion of the main body; sliding the two sliding arm plates down to the second latch positions such that the two sliding arm plates are put into sleeves of the T-shirts snuggly leaving no crease on top the T-shirts; printing a predetermined pattern on the top of the T-shirts; and sliding the two sliding arm plates up to the first latch positions and at the same time pulling the T-shirts off the sliding T-shirts printing pallet from the sliding T-shirts printing pallet.

The advantages of the present invention are: (1) the sliding T-shirts printing pallet can accommodates T-shirts of different sizes for printing; and (2) the sliding T-shirts printing pallet enables to accept and release a T-shirts without strain or over-stretching which may cause damage to the T-shirts.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

FIGS. 1-7 show a sliding T-shirts printing pallet 100 according to embodiments of the present invention.

An aspect of the invention provides the sliding T-shirts printing pallet 100.

The sliding T-shirts printing pallet 100 comprises a main body 110, two sliding arm plates 30, and two stretching bump portions 40.

Figure 1:
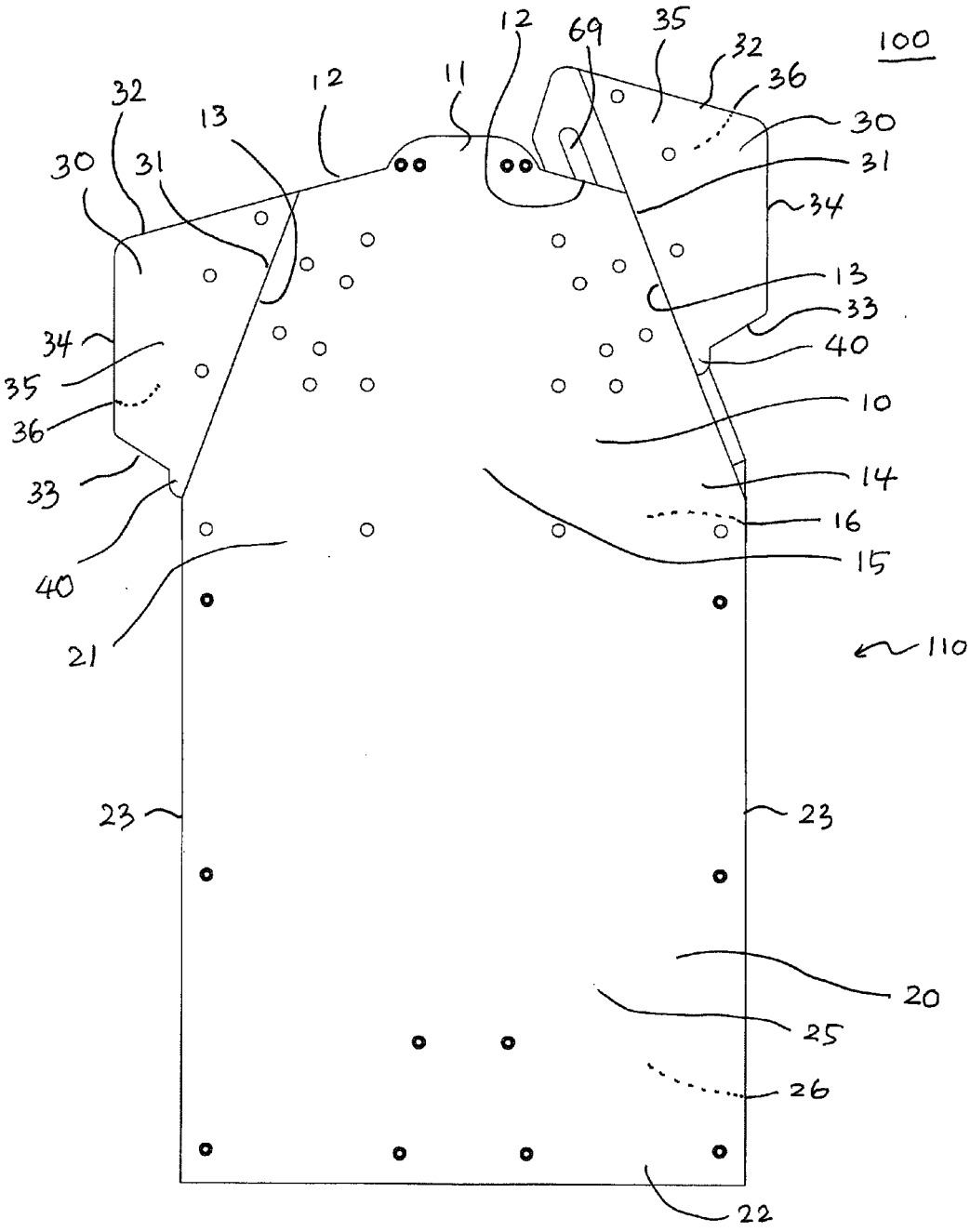
FIG. 1 is a front plan view showing a sliding T-shirts printing pallet with a sliding arm plates slid upward according to an embodiment of the present invention.
Figure 2:
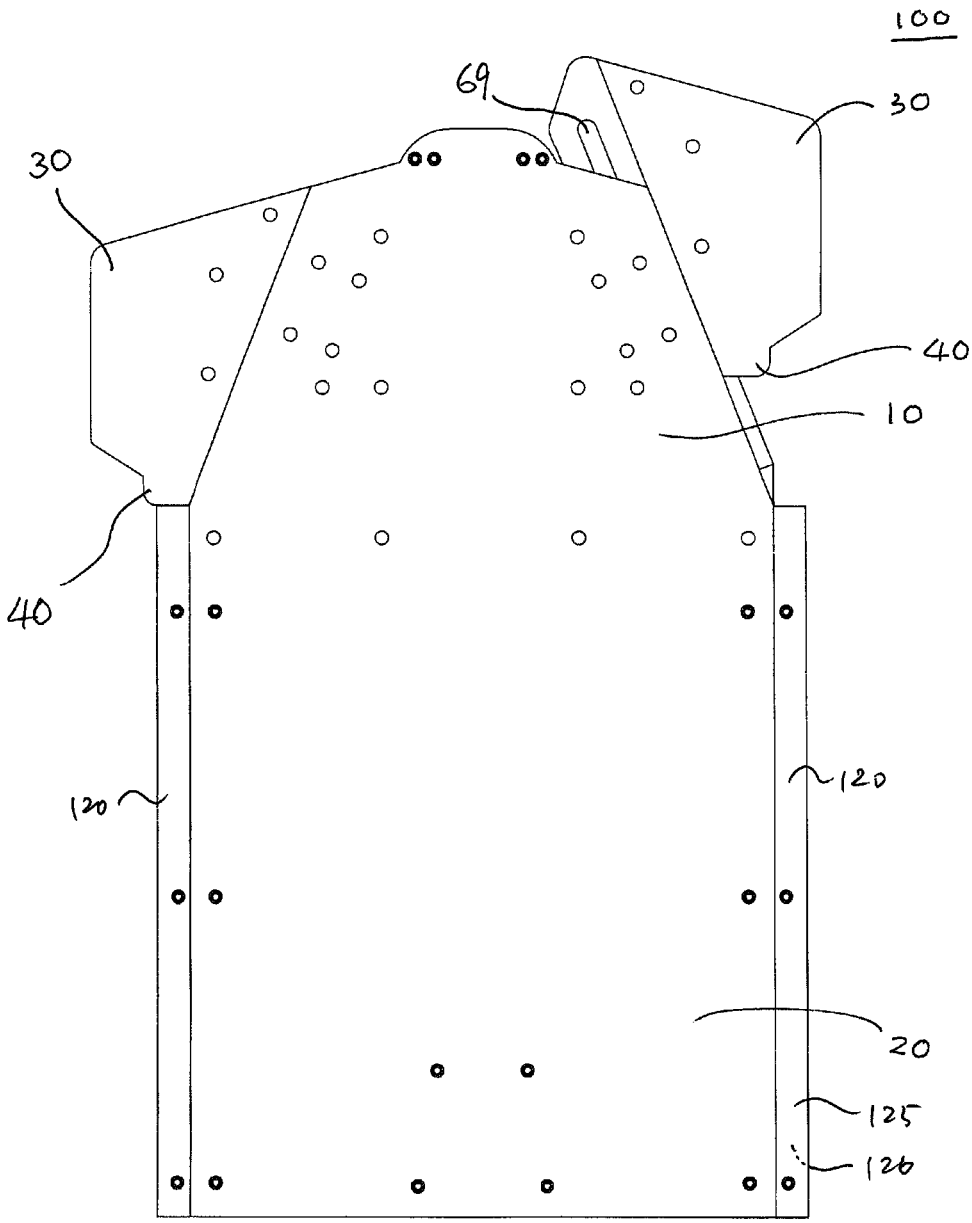
FIG. 2 is a front plan view showing a sliding T-shirts printing pallet having extending strips with a sliding arm plates slid upward according to an embodiment of the present invention.
Figure 3:
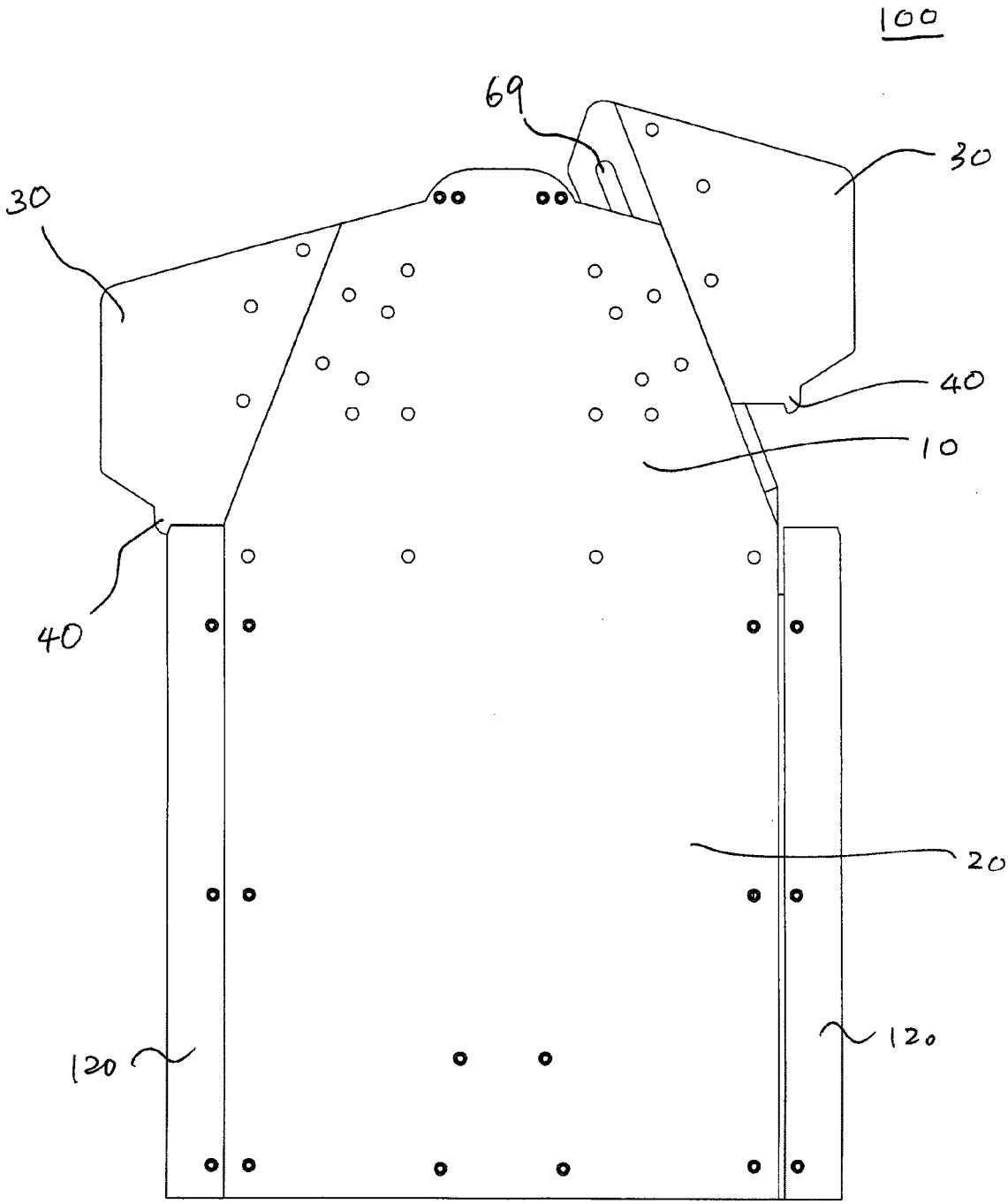
FIG. 3 is a front plan view showing another sliding T-shirts printing pallet having extending strips with a sliding arm plates slid upward according to an embodiment of the present invention.

The main body 110 comprises a substantially parallelogram top portion 10 and a substantially rectangular bottom portion 20 as shown in FIG. 1. The substantially parallelogram top portion 10 comprises a neck side 11, two shoulder sides 12, two shoulder blade sides 13, a lower chest side 14, a front surface 15, and a rear surface 16, and each of the shoulder blade sides 13 extends from a corresponding one of the two shoulder sides 12 and is tilted down outward. The substantially rectangular bottom portion 20 comprises a chest side 21, a waist side 22, two flank sides 23, a front surface 25, and a rear surface 26, and the chest side 21 extends from the lower chest side 14 of the parallelogram top portion 10 as shown mainly in FIG. 1.

Each of two sliding arm plates 30 is configured to be connected to a corresponding one of the two shoulder blade sides 13 of the main body 110 and to slide along the shoulder blade side 13, and comprises a sliding side 31, a shoulder side 32, an armpit side 33, a sleeve side 34, a front surface 35, and a rear surface 36.

The two stretching bump portions 40 are for flattening an armpit portion of the T-shirts (not shown), and each of two stretching bump portions 40 is disposed an inner edge of the armpit side 33 of the sliding arm plates 30.

The front surfaces 35 of the two sliding arm plates 30 are aligned with the front surfaces 15 of the parallelogram top portion 10 and the rectangular bottom portion 20 of the main body 110 so as to form a single plane.

Each of the two sliding arm plates 30 defines a first latch position as the sliding arm plate 30 in the right side of FIG. 1 when the sliding arm plate 30 is slid upward, and a second latch position as the sliding arm plate 30 in the left side of FIG. 1 when the sliding arm plate 30 is slid downward.

Each of the sleeve sides 34 is aligned relatively closely with a corresponding one of the flank sides 23 of the rectangular bottom portion 20 of the main body 110 when the sliding arm plates 30 are slid upward to the first latch position.

Figure 4:
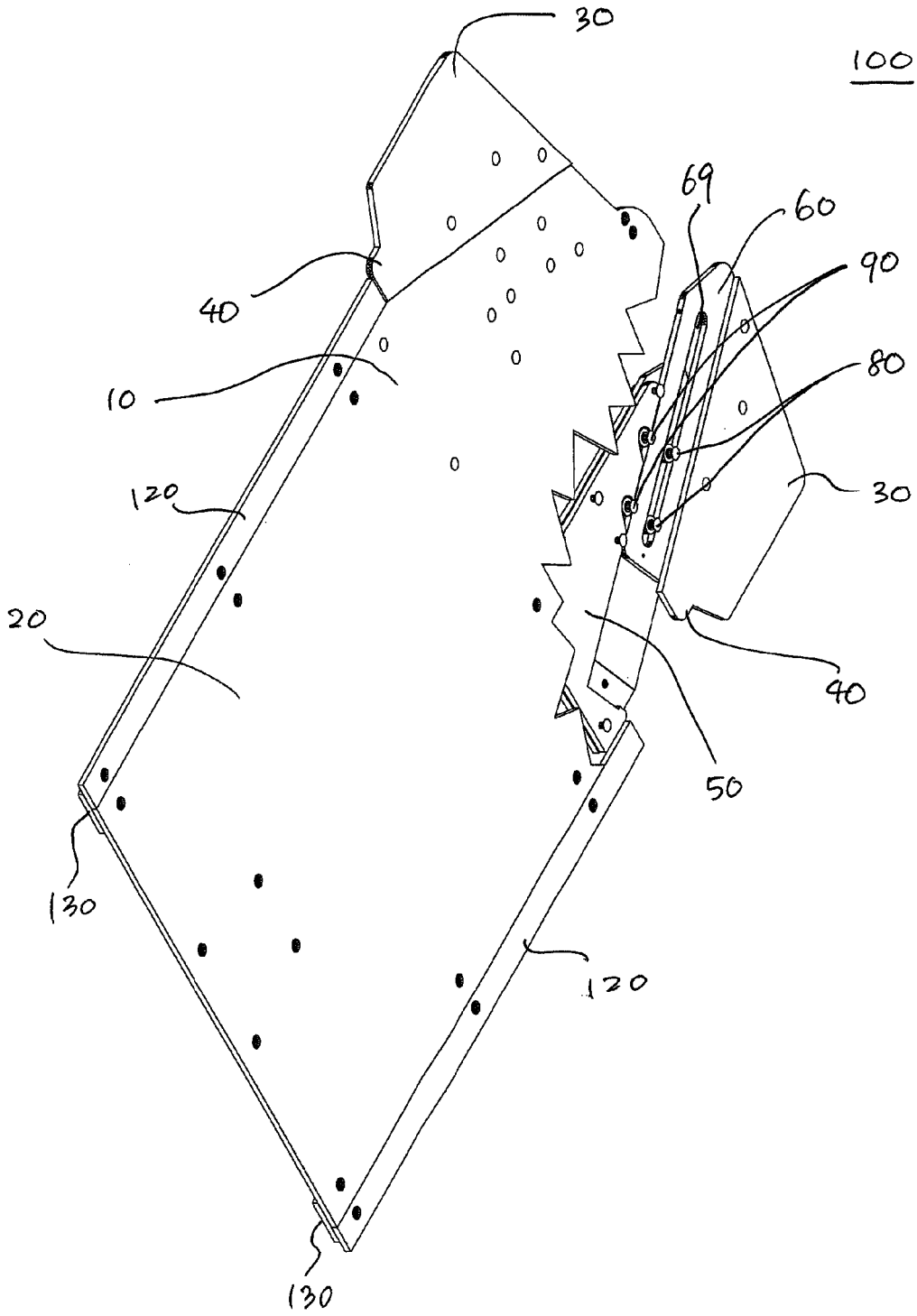
FIG. 4 is a perspective front view of a sliding T-shirts printing pallet with a partial portion cut out according to another embodiment of the invention.
Figure 5:
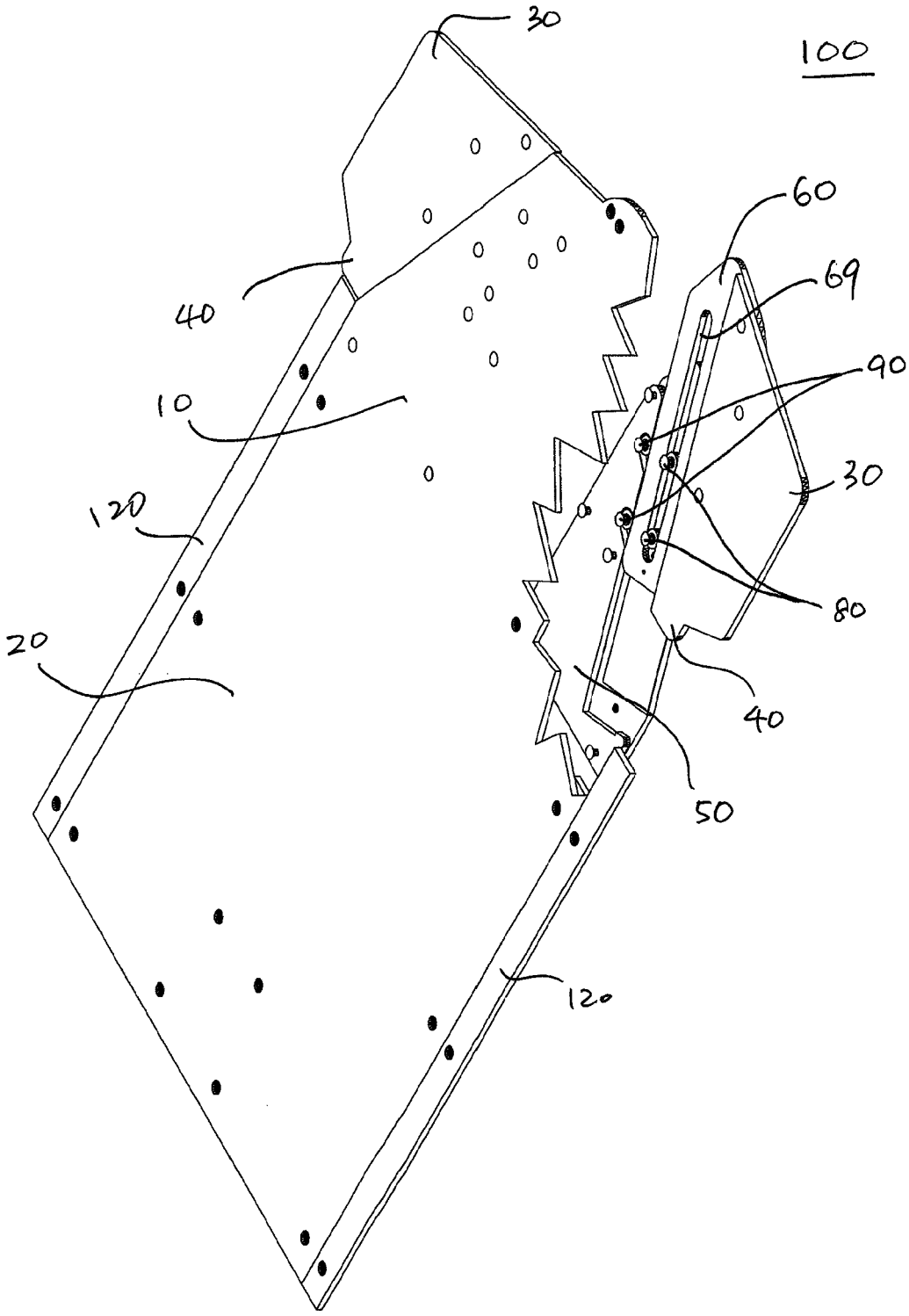
FIG. 5 is another perspective front view of the sliding T-shirts printing pallet of FIG. 4.
Figure 6:
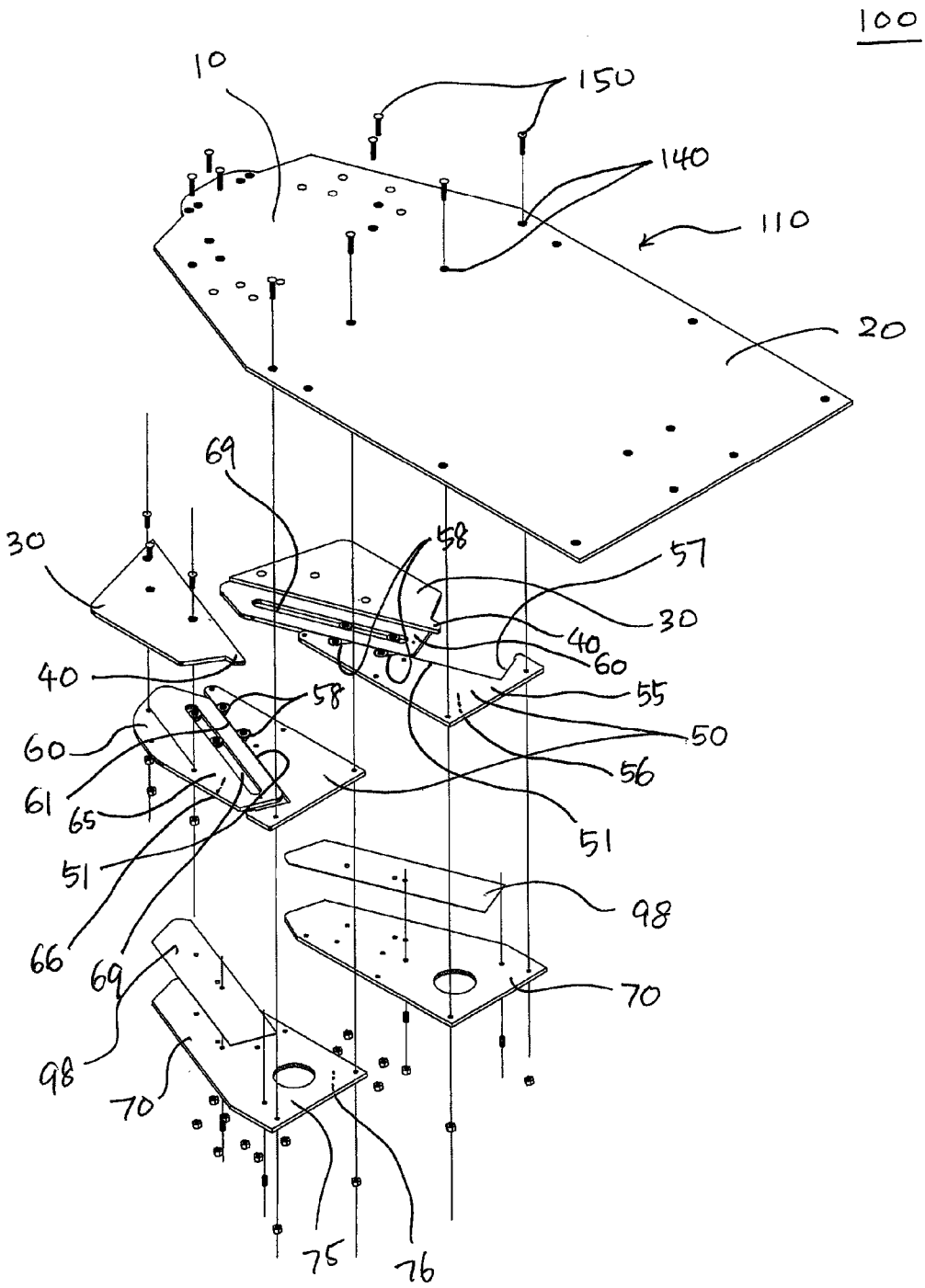
FIG. 6 is a exploded perspective view of a sliding T-shirts printing pallet according to another embodiment of the invention.

As shown in FIGS. 4-6, the sliding T-shirts printing pallet 100 may further comprise two first sliding guides 50, two second sliding guides 60, two bottom plates 70, and two or more first glide bearings 80.

The two first sliding guides 50 are fixed to the rear surface 16 of the parallelogram top portion 10 of the main body 110, and each comprises a first sliding side 51, a top surface 55, and a bottom surface 56.

The two second sliding guides 60 are fixed to the rear surface 36 of a corresponding one of the two sliding arm plates 30, and each comprises a top surface 65, a bottom surface 66, and a second sliding side 61 which is configured to slide along the first sliding side 51 of the first sliding guide 50. Each of the two second sliding guides 60 comprises an oblong sliding slot 69 extending generally parallel to the second sidling side 61.

Each of the two bottom plates 70 is fixed to the rear surface 56 of a corresponding one of the first sliding guides 50.

The two or more first glide bearings 80 are fixed to the front surface 75 of each of the bottom plates 70 and to the rear surface 16 of the main body 110 so as to guide the second sliding guides 60 along the oblong sliding slot 69.

Each of the first sliding guides 50 may further comprise a stopping side 57 for limiting movement of the corresponding second sliding guide 60 and sliding arm plate 30.

The outermost first glide bearings 80 may limit movement of the corresponding second sliding guide 60 and sliding arm plate 30.

The front surfaces 55 of the first sliding guides 50 may be aligned with the front surfaces 65 of the second sliding guides 60 so as to form a single plane.

The sliding T-shirts printing pallet 100 still may further comprise: a first impact-resistant layer 98 fixed to the front surface 75 of each of the bottom plates 70 between and disposed between the bottom plate 70 and the second sliding guide 60, and a second impact-resistant layer (not shown) fixed to the rear surface 16 of the parallelogram top portion 10 of the main body 110 and disposed between the parallelogram top portion 10 and the first and second sliding guides 50, 60 as shown in FIG. 6.

Each of the first and second impact-resistant layers 98 may comprise slippery UHMW Polyethylene.

Each of the first and second impact-resistant layers 98 may comprise an adhesive layer for fixing first and second impact-resistant layers 98 to the front surface 75 of each of the bottom plates 70 and to the rear surface 16 of the parallelogram top portion 10.

Each of the first sliding guides 50 may comprise two or more latching grooves 58 at the corresponding first sliding side 51, and the sliding T-shirts printing pallet 100 may further comprise two or more second glide bearings 90 fixed to the front surface 75 of each of the bottom plates 70 and to the rear surface 16 of the main body 110 through corresponding two or more latching grooves 58 so as to guide the second sliding guides 60 along the sliding sides 51 of the first sliding guides 50.

As shown in FIGS. 2-5, the sliding T-shirts printing pallet 100 may further comprise two extending strips 120, each of which being for extending the top surface 25 of the rectangular bottom portions 20 sideways, and each of the extending strips 120 may comprise a front surface 125 and a rear surface 126.

The sliding T-shirts printing pallet 100 may further comprise two connecting strips 130, each of which being for connecting the extending strips 120 to the rectangular bottom portion 20 at the rear surfaces 26 of the rectangular bottom portion 20 and the extending strip 120 as shown in FIG. 4.

The sliding T-shirts printing pallet 100 may further comprising: a plurality of holes 140 provided in the main body 110, the sliding arm plates 30, first and second sliding guides 50, 60, and the bottom plates 70, and a plurality of screws 150 for fixing the main body 110, the sliding arm plates 30, first and second sliding guides 50, 60, and the bottom plates 70 with one another.

Each of the two stretching bump portions 40 may have a generally parallelogram shape with round edge. Each of the two stretching bump portions may be integrated with the corresponding sliding arm plate 30 as shown in FIG. 1.

Figure 8:
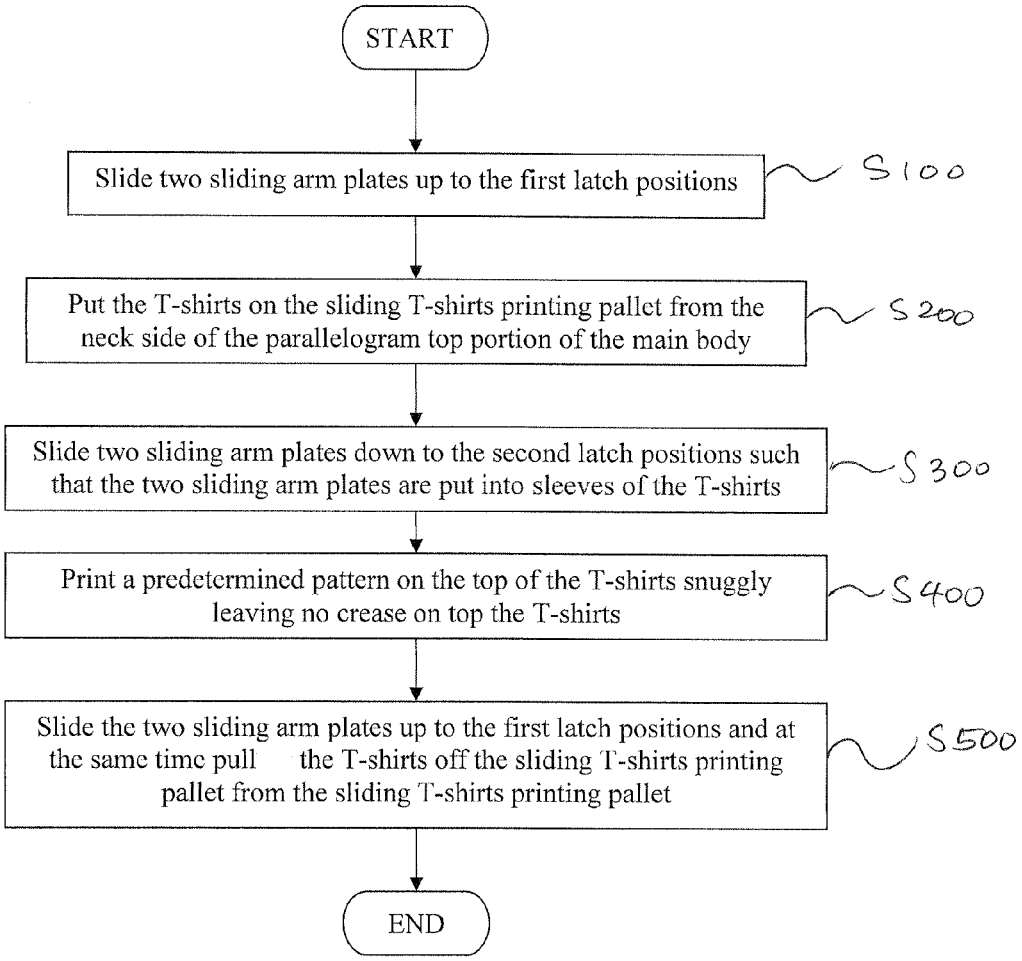
FIG. 8 is a flowchart illustrating steps of printing patterns on a T-shirts using a sliding T-shirts printing pallet according to the invention.

According to another aspect of the invention as shown in FIG. 8, a method for printing a T-shirts using the sliding T-shirts printing pallet is provided.

The method comprises: sliding the two sliding arm plates up to the first latch positions S100; putting the T-shirts on the sliding T-shirts printing pallet from the neck side of the parallelogram top portion of the main body S200; sliding the two sliding arm plates down to the second latch positions such that the two sliding arm plates are put into sleeves of the T-shirts snuggly leaving no crease on top the T-shirts S300; printing a predetermined pattern on the top of the T-shirts S400; and sliding the two sliding arm plates up to the first latch positions and at the same time pulling the T-shirts off the sliding T-shirts printing pallet from the sliding T-shirts printing pallet S500.

In certain embodiments of the invention, the first and second guide bearings 80, 90 are not limited to "bearings", but include any means to limit linear movement of the second sliding guides 60.

In certain embodiments, the plurality of holes 140 and screws 150 may be replaced with thermal welding or rivets.

Figure 7:
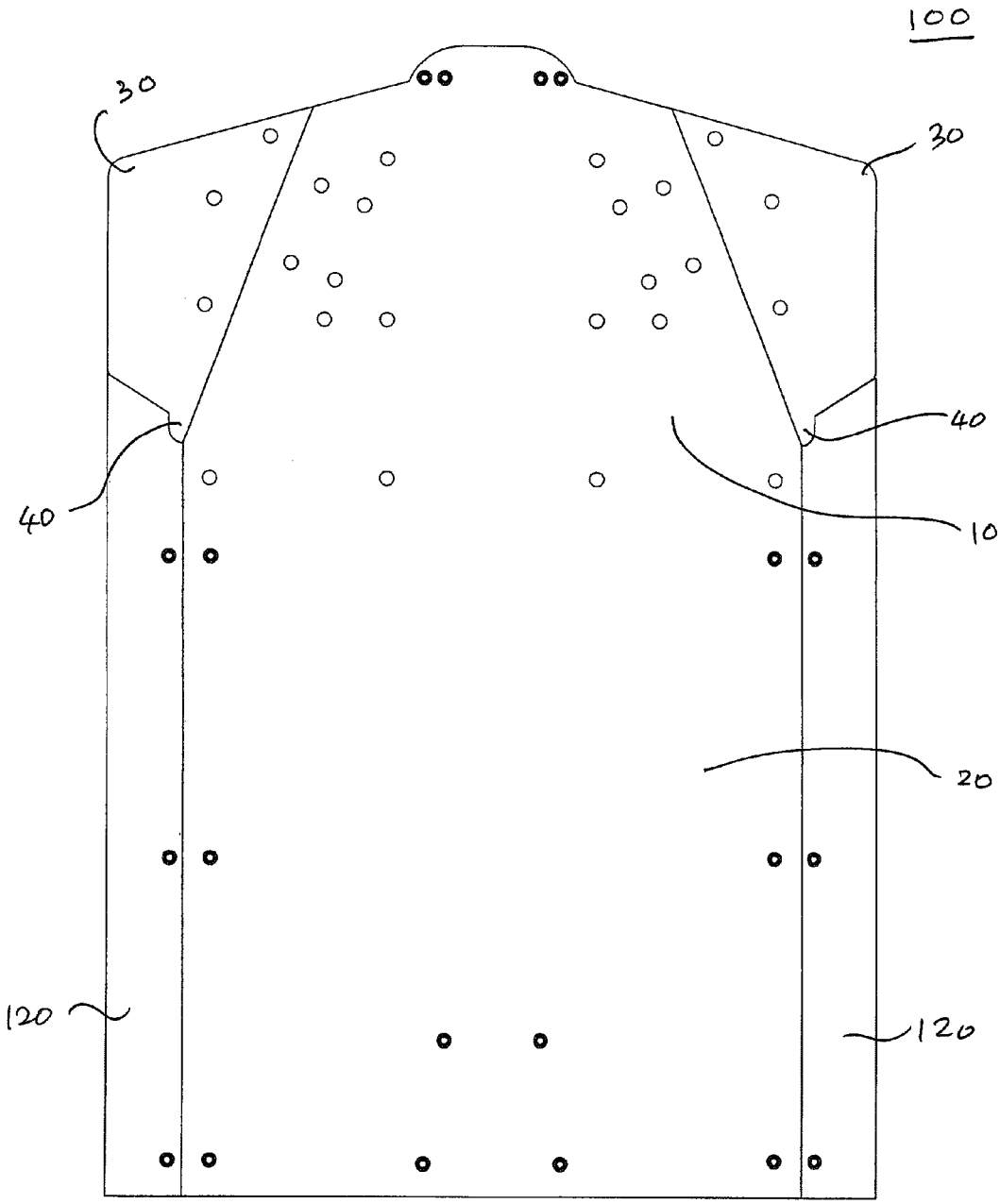
FIG. 7 is a front plan view of a sliding T-shirts printing pallet with extending strips to turn into a regular board according to another embodiment of the invention.

In certain embodiments, the extending strips 120 can be wide enough to reach out to the range of the sleeve sides 34, resulting in a regular board for printing as shown in FIG. 7.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A sliding T-shirts printing pallet, comprising:

a main body comprising:

a substantially parallelogram top portion comprising a neck side, two shoulder sides, two shoulder blade sides, a lower chest side, a front surface, and a rear surface, wherein each of the shoulder blade sides extends from a corresponding one of the two shoulder sides and is tilted down outward, and a substantially rectangular bottom portion comprising a chest side, a waist side, two flank sides, a front surface, and a rear surface, wherein the chest side extends from the lower chest side of the parallelogram top portion;

two sliding arm plates, each of which being configured to be connected to a corresponding one of the two shoulder blade sides of the main body and to slide along the shoulder blade side, wherein each of the sliding arm plates comprises a sliding side, a shoulder side, an armpit side, a sleeve side, a front surface, and a rear surface; and two stretching bump portions for flattening an armpit portion of the T-shirts, each of which being disposed an inner edge of the armpit side of the sliding arm plates, wherein the front surfaces of the two sliding arm plates are aligned with the front surfaces of the parallelogram top portion and the rectangular bottom portion of the main body so as to form a single plane, wherein each of the two sliding arm plates defines a first latch position when the sliding arm plate is slid upward and a second latch position when the sliding arm plate is slid downward, and wherein each of the sleeve sides is aligned relatively closely with a corresponding one of the flank sides of the rectangular bottom portion of the main body when the sliding arm plates are slid upward to the first latch position.

2. The sliding T-shirts printing pallet of claim 1, further comprising:

two first sliding guides fixed to the rear surface of the parallelogram top portion of the main body, comprising a first sliding side, a top surface, and a bottom surface;

two second sliding guides fixed to the rear surface of a corresponding one of the two sliding arm plates, comprising a top surface, a bottom surface, and a second sliding side which is configured to slide along the first sliding side of the first sliding guide, wherein each of the two second sliding guides comprises an oblong sliding slot extending generally parallel to the second sidling side;

two bottom plates, each of which being fixed to the rear surface of a corresponding one of the first sliding guides; and two or more first glide bearings fixed to the front surface of each of the bottom plates and to the rear surface of the main body so as to guide the second sliding guides along the oblong sliding slot.

3. The sliding T-shirts printing pallet of claim 2, wherein each of the first sliding guides further comprises a stopping side for limiting movement of the corresponding second sliding guide and sliding arm plate.

4. The sliding T-shirts printing pallet of claim 2, wherein outermost first glide bearings limit movement of the corresponding second sliding guide and sliding arm plate.

5. The sliding T-shirts printing pallet of claim 2, wherein the front surfaces of the first sliding guides are aligned with the front surfaces of the second sliding guides so as to form a single plane.

6. The sliding T-shirts printing pallet of claim 2, still further comprising:

a first impact-resistant layer fixed to the front surface of each of the bottom plates between and disposed between the bottom plate and the second sliding guide, and a second impact-resistant layer fixed to the rear surface of the parallelogram top portion of the main body and disposed between the parallelogram top portion and the first and second sliding guides.

7. The sliding T-shirts printing pallet of claim 6, wherein each of the first and second impact-resistant layers comprises slippery UHMW Polyethylene.

8. The sliding T-shirts printing pallet of claim 6, wherein each of the first and second impact-resistant layers comprises an adhesive layer for fixing.

9. The sliding T-shirts printing pallet of claim 2, each of the first sliding guides comprises two or more latching grooves at the corresponding first sliding side, and the sliding T-shirts printing pallet further comprising two or more second glide bearings fixed to the front surface of each of the bottom plates and to the rear surface of the main body through corresponding two or more latching grooves so as to guide the second sliding guides along the sliding sides of the first sliding guides.

10. The sliding T-shirts printing pallet of claim 1, further comprising two extending strips, each of which being for extending the top surface of the rectangular bottom portions sideways, wherein each of the extending strips comprises a front surface and a rear surface.

11. The sliding T-shirts printing pallet of claim 10, further comprising two connecting strips, each of which being for connecting the extending strips to the rectangular bottom portion at the rear surfaces of the rectangular bottom portion and the extending strip.

12. The sliding T-shirts printing pallet of claim 11, further comprising:

a plurality of holes provided in the main body, the sliding arm plates, first and second sliding guides, and the bottom plates, and a plurality of screws for fixing the main body, the sliding arm plates, first and second sliding guides, and the bottom plates with one another.

13. The sliding T-shirts printing pallet of claim 1, wherein each of the two stretching bump portions has a generally parallelogram shape with round edge.

14. The sliding T-shirts printing pallet of claim 13, wherein each of the two stretching bump portions is integrated with the corresponding sliding arm plate.

15. A method for printing a T-shirts using the sliding T-shirts printing pallet according to claim 1, comprising:

sliding the two sliding arm plates up to the first latch positions;

putting the T-shirts on the sliding T-shirts printing pallet from the neck side of the parallelogram top portion of the main body;

sliding the two sliding arm plates down to the second latch positions such that the two sliding arm plates are put into sleeves of the T-shirts snuggly leaving no crease on top the T-shirts;

printing a predetermined pattern on the top of the T-shirts; and sliding the two sliding arm plates up to the first latch positions and at the same time pulling the T-shirts off the sliding T-shirts printing pallet from the sliding T-shirts printing pallet.

* * * * *